United States Patent [19]

Watanabe et al.

[11] 4,369,800

[45] Jan. 25, 1983

[54] COIN HANDLING APPARATUS HAVING A SIGNAL OPERATED BLOCKER

[75] Inventors: Kenkichi Watanabe; Katusuke Furuya; Toyoki Kimoto, all of Tokyo, Japan

[73] Assignee: Laurel Bank Machine Co., Ltd., Tokyo, Japan

[21] Appl. No.: 252,783

[22] Filed: Apr. 10, 1981

[30] Foreign Application Priority Data

Apr. 15, 1980 [JP] Japan ..... 55-49442

[51] Int. Cl.[3] ..... G07D 9/04

[52] U.S. Cl. ..... 133/8 R

[58] Field of Search ..... 133/1 R, 8 R, 8 A, 8 B, 133/8 E, 3 R; 221/12; 53/212, 501

[56] References Cited

U.S. PATENT DOCUMENTS 3,757,805 9/1973 Puhahn et al. ..... 133/8 R 3,777,769 12/1973 Ueno ..... 133/8 R

*Primary Examiner*—Stanley H. Tollberg

*Attorney, Agent, or Firm*—Fleit & Jacobson

[57] ABSTRACT

Herein disclosed is a coin handling apparatus which is free from having its coin guide passage from being jammed with coins when the supply of any more coins is to be stopped. The coin handling apparatus is of the type including, as customary, a rotary disc, a guide passage, a conveyor belt and a coin stacking cylinder. The coin handling apparatus is improved to include a rotary stop pin disposed in the guide passage for normally opening the guide passage and for closing the same thereby to block the succeeding coins, a rotary solenoid for controlling the opening and closing operations of the stop pin, a detecting device for detecting the coin, which is to pass therethrough in the guide passage, thereby to generate two outputs, a coin stop control unit for operating a controlled stop signal in accordance with both the outputs of the detecting device and a stop signal, and a drive circuit for driving the rotary solenoid in accordance with the controlled stop signal thereby to effect the closing operation of the rotary stop pin. The detecting device has a pair of photo-sensors for optically detecting the position of the coin just passing therethrough, and a coin detecting unit connected with the photo-sensors for converting the position of the coin into a binary logic level.

8 Claims, 5 Drawing Figures

COIN HANDLING APPARATUS HAVING A SIGNAL OPERATED BLOCKER

BACKGROUND OF THE INVENTION

1. Field of the Invention

The present invention relates to an improvement in a coin handling apparatus of the type, in which coins are prevented from jamming in a guide passage when this passage is to be closed.

2. Description of the Prior Art

In a coin handling apparatus such as a coin packaging apparatus, in case where the supply of coins to a coin stacking cylinder is stopped by a rotary stop pin through a stop signal generated when a predetermined number of coins has been counted and thereby the supply of coins to the coin stacking cylinder should be stopped, there arises no problem of coin jamming since the stop signal for driving the rotary stop pin is designed to be generated under a condition that the coin passing through the coin passage, to be stopped, reaches a suitable position relative to the rotary stop pin so as to cause no jamming. In the meanwhile, in the coin packaging apparatus, it is desirable to stop the supply of the coins at an optional time, and for this purpose, means is provided for optionally issue a stop signal to drive the rotary stop pin. In such a case, when the rotary stop pin is driven to stop the supply of coins at an optional time, there arises a problem that the coins are jammed between a conveyor belt and the rotary stop pin. More particularly, in case where a stop signal is issued when the coin to be stopped reaches just before the rotary stop pin, an upwardly projecting semi-circular top portion of the rotary stop pin is projected into the coin passage through its rotation to strike against the coin just passing by, which is forced by the conveyor belt to move toward the coin stacking cylinder and as a result the coin thus stricken rides on the rotary stop pin. Still the worse, there is invited to defect that the coin or coins are bitten between the side edge portion of the guide passage and the rotary stop pin so that the rotary stop pin cannot be reversely moved to its initial position even by issuing a signal for reversing the rotary stop pin.

SUMMARY OF THE INVENTION

In view of the background thus far described, therefore, it is an object of the present invention to provide a coin handling apparatus which has its coin guide passage prevented from being jammed with coins when it is to be closed.

According to a feature of the present invention, there is provided a coin handling apparatus including: selecting means for selecting a predetermined kind of coins from the remaining coins; a guide passage disposed adjacent to said selecting means for guiding the selected coins therethrough; conveyor means for conveying said selected coins on said guide passage; and handling means disposed downstream of said guide passage for handling the coins having been conveyed thereto, wherein the improvement comprises: blocking means disposed in said guide passage for normally opening said guide passage and for closing the same thereby to block the succeeding coins; passage control means for controlling the opening and closing operations of said blocking means; detecting means for detecting the coin, which is to pass therethrough in said guide passage, thereby to generate outputs; stop signal generating means for generating a stop signal to stop said coin; coin stop control means for generating a controlled stop signal in accordance with both the outputs of said detecting means and the stop signal of said stop signal generating means; and drive means for driving said passage control means in accordance with the controlled stop signal of said coin stop control means thereby to effect the closing operation of said blocking means, whereby said coin is prevented from jamming between said conveyor means and said blocking means when said blocking means is driven to stop supply of any more coins to said handling means.

BRIEF DESCRIPTION OF THE DRAWINGS

Other objects, features and advantages of the present invention will become apparent from the following description taken in conjunction with the accompanying drawings, in which.

DESCRIPTION OF THE PREFERRED EMBODIMENT

The present invention will now be described in connection with one embodiment thereof with reference to the accompanying drawings.

Figure 1:
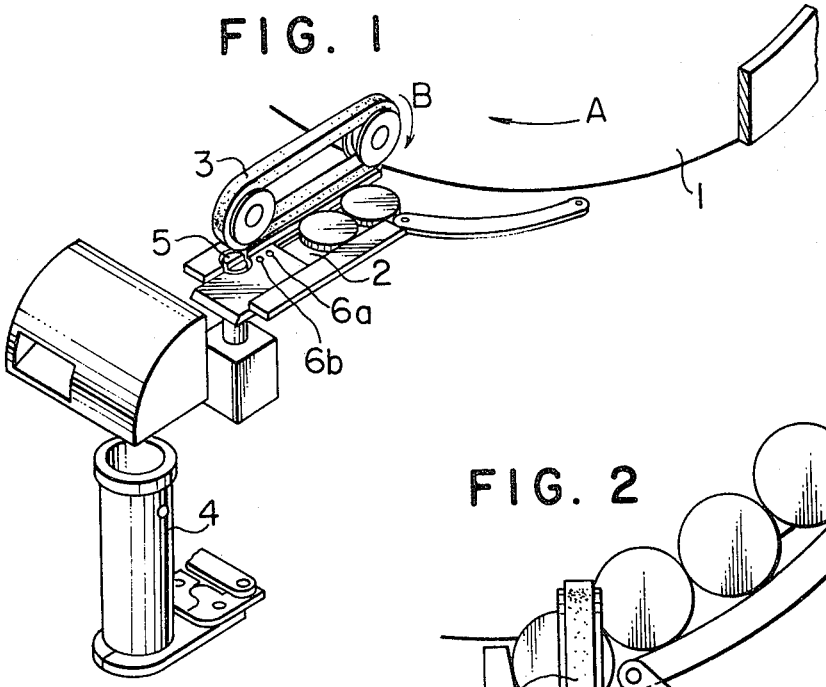
FIG. 1 is a perspective view showing an example of a coin packaging apparatus.

In the coin packaging apparatus, as shown in FIG. 1, the coins are consecutively introduced from a rotary disc 1, which is rotating in the direction of arrow A, onto a guide passage 2 and are conveyed by a conveyor belt 3, which is made to run in the direction of arrow B, until they are stacked in a coin stacking cylinder 4. In this case, the guide passage 2 is equipped with both a rotary stop pin 5 for opening and closing the passage 2 and a pair of photo-sensors *6a* and *6b* for counting the number of the coins being conveyed on the passage 2 and for detecting the position of the same. As best seen in FIG. 1, the rotary stop pin has an upwardly projecting semi-circular portion or notched head at the top thereof which is in a retracted position when the coins are moved toward the coin stacking cylinder during counting operation, and which is projected into the coin passage through its rotation when the supply of the coins is stopped. When the number of the coins stacked in the coin stacking cylinder 4 reaches a predetermined value, the rotary stop pin is rotationally driven by a drive mechanism such as a rotary solenoid thereby to interrupt the introduction of the coins into the coin piling cylinder 4.

Figure 2:
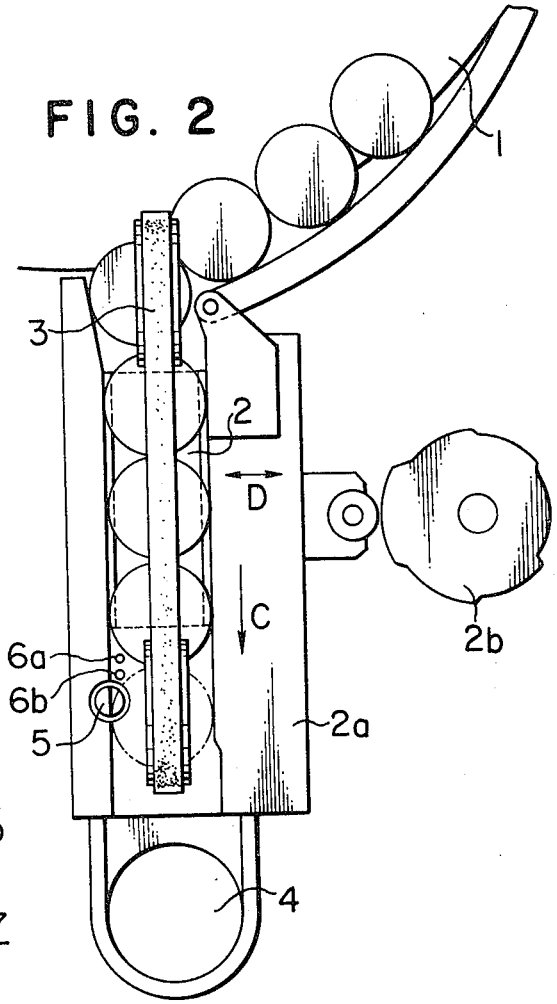
FIG. 2 is a top plan view showing an essential portion of the present invention.
Figure 3:
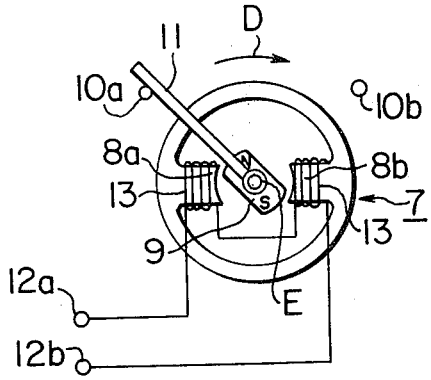
FIG. 3 is a top plan view showing the construction of a rotary solenoid to be incorporated into the present invention.

FIG. 2 is a top plan view showing an essential portion of the counting unit of the coin handling apparatus according to the present invention. The elements corresponding to those shown in FIG. 1 are indicated at identical numerals in FIG. 2. As shown, reference numeral 2 indicates the guide passage through which the coins are guided to pass. At one side portion of the passage 2, there is arranged the rotary stop pin 5 which is rotationally driven to open and close the passage 2. At the same side portion of the passage 2, there are arranged the paired photo-sensors 6*a* and 6*b* which are arranged tandem in the vicinity of and downstream of the rotary stop pin 5 along the side edge of the passage 2. In accordance with this arrangement, more specifically, the photo-sensors 6*a* and 6*b* are positioned at the side of the rotary disc 1 with respect to the rotary stop pin 5 such that the photo-sensor 6*b* is positioned at the side of the rotary stop pin 5 with respect to the other photosensor 6*a*. As has been touched before, the photo-sensors 6*a* and 6*b* thus positioned are made operative to count the number of the coins passing therethrough and to detect the positions of the same and are made of light-receiving elements such as phototransistors. A light emitting element (although not shown) such as a light emitting diode is arranged to face those photo-sensors 6*a* and 6*b*. Incidentally, the other side edge portion 2*a* of the passage 2 is attached in a manner to move in the direction of arrow D so that the width of the passage 2 can be freely adjusted by the action of a cam 2*b* or the like in accordance with the kinds of the coins. On the other hand, the rotary stop pin 5 is rotationally driven by a rotary solenoid 7, the construction of which is shown in detail in FIG. 3.

This rotary solenoid 7 is provided with a pair of protrusions 8*a* and 8*b*, which are made to protrude inwardly from the diametrical opposite portions of a core having a cylindrical shape, for example, in a manner to face each other, a polarized magnet 9, which is interposed between those protrusions 8*a* and 8*b* such that it can rotate on an axis E, an arm 11, which is fixed to that magnet 9 so that it can swing between a pair of stoppers 10*a* and 10*b*, and a pair of coils 13 which are wound upon the aforementioned protrusions 8*a* and 8*b* thereby to swing the aforementioned arm 11 between the stoppers 10*a* and 10*b* in response to the polarities of the pulses fed between a pair of input terminals 12*a* and 12*b*.

In the rotary solenoid 7 thus constructed, moreover, in case an electric current is fed in the direction from the input terminal 12*b* to the input terminal 12*a*, an N polarity is established on the inner circumference of the protrusion 8*a* whereas an S polarity is established on the inner circumference of the other protrusion 8*b*. Since, moreover, the protrusions 8*a* and 8*b* and the magnet 9 have their identical polarities facing each other, repulsive forces are generated, in-between so that the arm 11 is swung in the direction of arrow D from the position of the stopper 10*a* until it reaches the other stopper 10*b*. Here, since the magnet 9 will continue forming a more stable magnetic path even if no current is fed between the input terminals 12*a* and 12*b*, the arm 11 is held at the position of the stopper 10*b*. In the drive mechanism for driving the rotary stop pin 5 with the use of the rotary solenoid 7, more specifically, the arm 11 is swung between the stoppers 10*a* and 10*b* in accordance with the polarities of the pulses to be fed between the input terminals 12*a* and 12*b*, and these swinging motions are transmitted by connecting means, not shown, to the rotary stop pin 5, whereby the coins are conveyed and stopped.

In order that the coins in the passage 2 may be stopped in response to a stop signal in a manner to be prevented from jamming, the positions of the coins in the passage 2 have to be detected to drive the rotary solenoid 7 so that the rotary stop pin 5 is rotated about a right angle in the aforementioned direction D.

Figure 4:
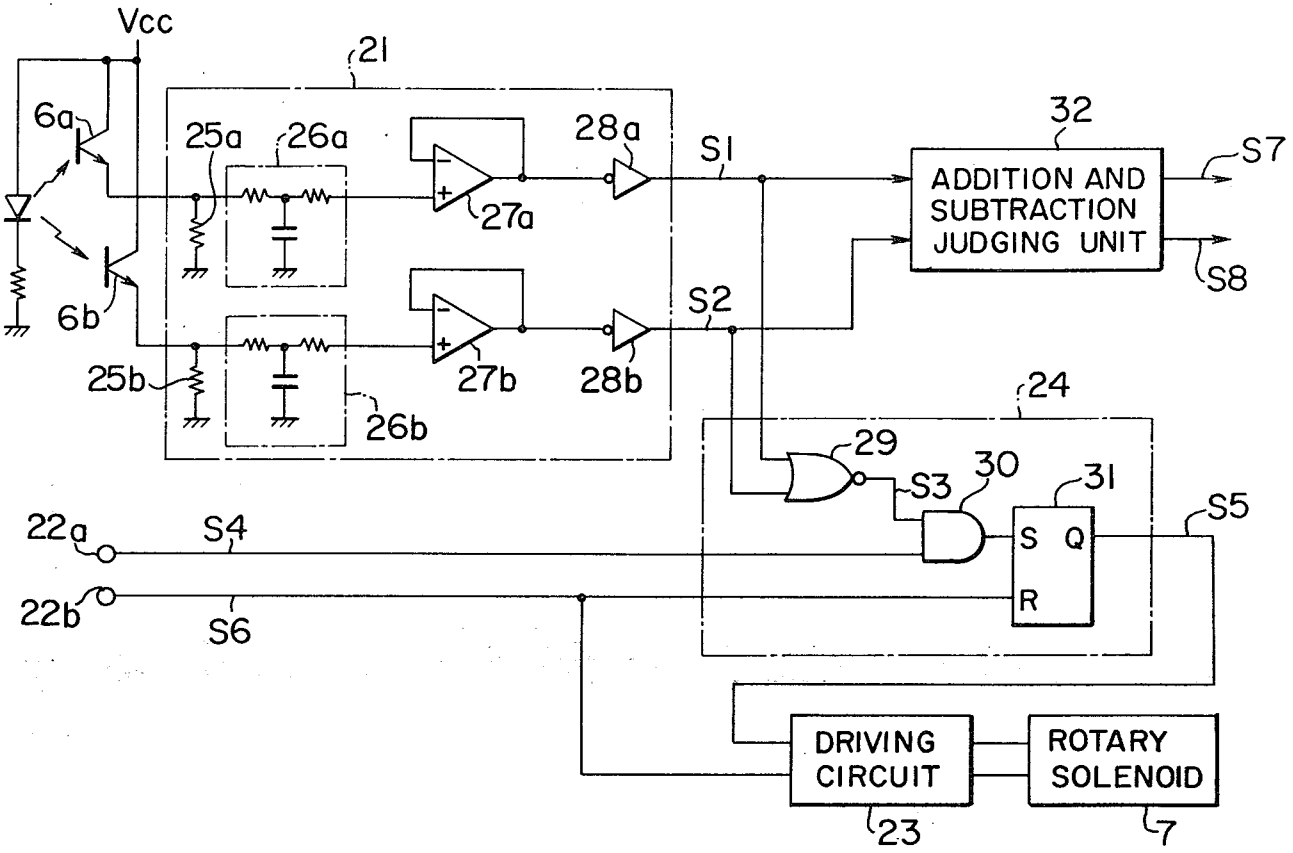
FIG. 4 is a block diagram showing a circuit to be used as an essential element in the present invention.

FIG. 4 is a block diagram showing a coin detecting unit 21, which is made operative to convert the position of the coin located by the photo-sensors 6*a* and 6*b* into a binary logic level, and a coin stop control unit 24 which is made operative to control the stop signal from an input terminal 22*a* in accordance with the two signals from the coin detecting unit 21 thereby to drive the rotary solenoid 7 through a drive circuit 23 in accordance with that controlled stop signal.

As shown, the coin detecting unit 21 includes a pair of resistors 25*a* and 25*b*, which are connected between the respective emitters of the photo-sensors 6*a* and 6*b* and the earth, a pair of voltage followers 27*a* and 27*b*, which are fed through a pair of filter circuits 26*a* and 26*b*, respectively, with the voltages from the respective emitters of those photo-sensors 6*a* and 6*b*, and a pair of inverters 28*a* and 28*b* which are fed with the respective outputs of those voltage followers 27*a* and 27*b*. Moreover, when the photo-sensors 6*a* is shielded by a coin, it is rendered inconductive so that the output signal S1 of the inverter 28*a* is shifted from the value "0" to the value "1" of the binary logic level. Likewise, when the other photo-sensor 6*b* is shielded by the coin, the output signal S2 of the inverter 28*b* is shifted from the value "0" to the value "1".

The coin stop control unit 24 includes a NOR gate 29, which is made operative to take the logic sum of the output signals S1 and S2 of the inverters 28*a* and 28*b* and to invert the logic sum taken, an AND gate 30, which is made operative to take the logic product of the output signal S3 of that NOR gate 29 and the stop signal S4 of the input terminal 22*a*, and an SR flip-flop 31 which has its S terminal fed with the output of that AND gate 30 thereby to generate a controlled stop signal S5 from its output terminal Q. More specifically, the coin stop control unit 24 is made operative to control the stop signal S4 of the input terminal 22*a* by taking its logic product with the output signal S3 of the NOR gate 29 and to feed out the controlled stop signal S5 from the SR flip-flop 31 to the drive circuit 23.

This drive circuit 23 is made operative to drive the rotary solenoid 7 in accordance with the controlled stop signal S5 thereby to rotate the aforementioned rotary stop pin 5 about a right angle in the aforementioned direction D.

On the other hand, the aforementioned SR flip-flop 31 has its input terminal R fed with the count starting signal S6 of an input terminal 22*b* thereby to interrupt the output of the aforementioned controlled stop signal S5. That count starting signal S6 is also fed to the drive circuit 23 thereby to reverse the rotary solenoid 7 so that the rotary stop pin 9 is rotated in the opposite direction to the aforementioned direction D. Incidentally, the count starting signal S6 and the stop signal S4 are designed so that they are not simultaneously generated.

In addition and subtraction judging unit 32 is made receptive of the output signals S1 and S2 of the aforementioned inverters 28*a* and 28*b* thereby to fed out either an addition signal S7 or a subtraction signal S8 for the counting operation.

The operations of the construction thus far described will be described in the following.

Figure 5:
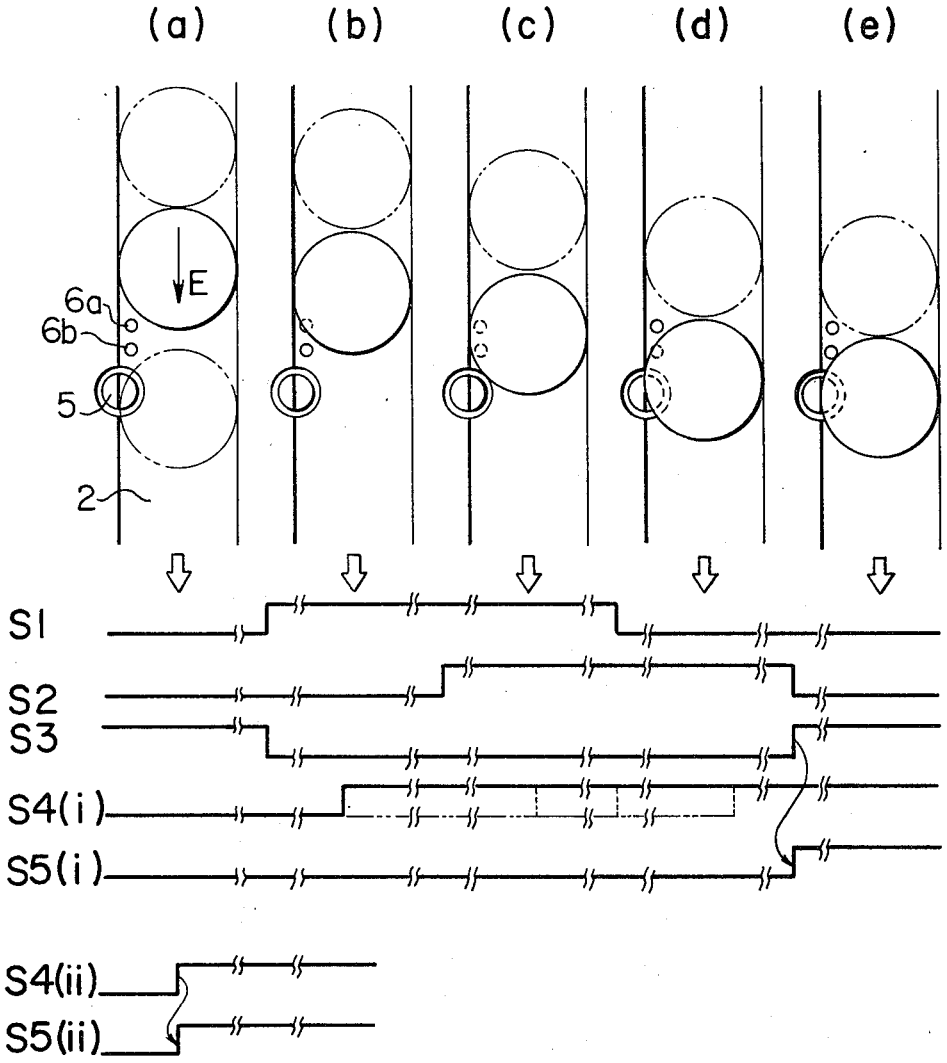
FIG. 5 is top plan views and timing charts both for explaining the operations of the present invention.

FIG. 5 is top plan views for explaining the relationships between the conditions of the coins in the passage 2 and the operations of the photo-sensors 6*a* and 6*b* and the rotary stop pin 5.

First of all, under the condition shown in FIG. 5(*a*), the photo-sensors 6*a* and 6*b* are rendered conductive because they receive the light coming from the light emitting diode. As a result, the voltages established at the respective emitters of the photo-sensors 6a and 6b are at their high states and fed through the filter circuits 26a and 26b, respectively, to the voltage followers 27a and 27b. And, the respective voltage of the voltage followers 27a and 27b are impressed upon the inverters 28a and 28b so that both the output signals S1 and S2 of the inverters 28a and 28b take the value "0". As a result, the output signal S3 of the NOR gate 29 takes the value "1" (because of the relationship of $\overline{\text{"0"}+\text{"0"}}=\overline{\text{"0"}}=\text{"1"}$).

In case the coins advance in the direction of the arrow E until they reach the condition shown in FIG. 5(*b*), the photo-sensor 6a is shielded by the leading coin so that the signal S1 takes the value "1" as a result of the operation reverse to the aforementioned one. As a result, the signal S3 takes the value "0" thereby to close the AND gate 30. It is assumed that the stop signal S4(*i*) take the value "1" under that particular condition. In this case, since the AND gate 30 is closed, the SR flip-flop 31 cannot be set so that the signal S5(*i*) holds the condition of the value "0".

Next, under the condition shown in FIG. 5(*c*) or 5(*d*), the signals S1 and S2 take the values "1" and "1" or the values "0" and "1", which are logically summed by the NOR gate 29 so that the signal S3 takes the value "0". As a result, the AND gate 30 is still closed, as under the condition shown in FIG. 5(*b*), so that the signal S5(*i*) holds the condition of the value "0".

At the time when the condition is shifted from that shown in FIG. 5(*d*) to that shown in FIG. 5(*e*), the signal S3, which has been inverted by taking the logic sum of the signals S1 and S2, is shifted from the value "0" to the value "1". In this instance, the SR flip-flop 31 of the coin stop control unit 24 feeds out the controlled stop signal S5 which is stored and held at the value "1" of the signal S3 so that the signal S5(*i*) is shifted from the value "0" to the value "1". And, this signal at the value "1" is fed to the drive circuit 23, which in turn drives the rotary solenoid 7 so that this rotary solenoid 7 rotates the rotary stop pin 5 in the aforementioned direction D. Under the condition shown in FIG. 5(*e*), in other words, the rotary stop pin 5 is rotated. In this instance, it should be noted that the displacement of the leading coin and the operation of the rotary stop pin 5 are synchronized to prevent the coins from jamming.

Moreover, it should be assumed that the stop signal S4(*ii*) is shifted from the value "0" to the value "1" under the condition shown in FIG. 5(*a*). In this instance, the photo-sensors 6a and 6b are not shielded by the leading coin, and the output signal S3 of the NOR gate 29 takes the value "1" so that the AND gate 30 is opened. As a result, simultaneously as the controlled stop signal S5(*ii*) is raised from the value "0" to the value "1", the SR flip-flop 31 is set to raise the output signal S5 from the value "0" to the value "1". Subsequently, the rotary stop pin 5 is similarly rotated in the aforementioned direction D.

More specifically, while the leading coin is being detected by the photo-sensors 6a and 6b, the rotary solenoid 7 is not driven before that coin has passed over the photo-sensors 6a and 6b, even if the stop signal S4 takes the value "1". On the other hand, as soon as the stop signal S4 takes the value "1" when no coin is detected, the rotary solenoid 7 is driven to block the passage of the coins. Incidentally, when the rotary solenoid 7 drives the rotary stop pin 5, not only the response time for the rotary solenoid 7 to be fed with its drive signal thereby rotate the rotary stop pin 5 but also the moving speed of the coins (as shown in FIG. 2) in the direction of arrow C raise other problems. In order to solve these problems, a delay circuit, which can have its offset value preset and varied in accordance with the moving speed of the coins, may be connected between the coin stop control unit 24 and the drive circuit 23.

As has been described hereinbefore, according to the present invention, the stop signal to stop the coins is controlled in accordance with the position of the leading coin, which is located by the coin detecting sensor, so that the passage for guiding the coins therethrough is blocked by the action of the rotary solenoid. As a result, it is possible to prevent the passage from being jammed with the coins and to allow the rotary stop pin 5 to easily restore its original position at the next start of the counting operation.

Incidentally, although the foregoing description is directed to the construction in which the rotary stop pin is rotated with respect to the guide passage 2 so that this passage 2 is opened and closed to effect and stop the supply of the coins, it is apparent that the present invention can also be applied to the construction in which a stop pin is provided to protrude in a vertical or horizontal direction to open and close the guide passage 2.

What is claimed is:

1. A coin handling apparatus including: selecting means for selecting a predetermined kind of coins from the remaining coins; a guide passage disposed adjacent to said selecting means for guiding the selected coins therethrough; conveyor means for conveying said selected coins on said guide passage; and handling means disposed downstream of said guide passage for handling the coins having been conveyed thereto, wherein the improvement comprises: blocking means disposed in said guide passage for normally opening said guide passage and for closing the same thereby to block the succeeding coins; passage control means for controlling the opening and closing operations of said blocking means; detecting means for detecting the coin, which is to pass therethrough in said guide passage, thereby to generate outputs; stop signal generating means for generating a stop signal to stop said coin; coin stop control means for generating a controlled stop signal in accordance with both the outputs of said detecting means and the stop signal of said stop signal generating means; and drive means for driving said passage control means in accordance with the controlled stop signal of said coin stop control means thereby to effect the closing operation of said blocking means, whereby said coin is prevented from jamming between said conveyor means and said blocking means when said blocking means is driven to stop supply of any more coins to said handling means.

2. A coin handling apparatus according to claim 1, wherein said blocking means includes a rotary stop pin having a notched head and positioned in one of the side walls of said guide passage such that it can rotate at a predetermined angle to open said guide passage, when said notched side coextends with the inner side of the corresponding side wall of said guide passage, and to close said guide passage when said notched side protrudes at said predetermined angle into said guide passage.

3. A coin handling apparatus according to claim 2, wherein said passage control means includes a rotary solenoid made rotatable back and forth at said predetermined angle.

4. A coin handling apparatus according to claim 3, wherein said rotary solenoid includes a shaft connected to said rotary pin, a cylindrical core enclosing said shaft, a pair of protrusions protruding inwardly from the diametrically opposite portions of said cylindrical core in a manner to face each other, a polarizied magnet supported on said shaft and made rotatable therewith to and from said protrusions, an arm fixed to said polarized magnet, a pair of stoppers spaced angularly around said shaft for determining the angular stroke of the swings of said arm and accordingly said predetermined angle of said rotary pin through said polarized magnet and said shaft, a pair of input terminals made receptive of pulses, and a pair of coils respectively wound on said protrusions and connected with said input terminals for swinging said arm between said stoppers in accordance with the polarities of the pulses fed through said input terminals.

5. A coin handling apparatus according to claim 1, further comprising count starting signal generating means for generating a count starting signal which is fed both to said coin stop control means in the absence of the stop signal of said stop signal generating means and to said drive means together with the controlled output signal of said coin stop control means thereby to effect the opening operation of said blocking means.

6. A coin handling apparatus according to claim 1, wherein said detecting means includes a pair of photo-sensors arranged tandem in the bottom of said guide passage for optically detecting the position of said coin just passing therethrough, and a coin detecting unit connected with said photo-sensors for converting the position of said coin, which is detected by said photo-sensors, into a binary logic level.

7. A coin handling apparatus according to claim 6, wherein said coin detecting unit includes a pair of resistors connected between the respective emitters of said photo-sensors and the earth, a pair of filter circuits connected with the respective emitters of said photo-sensors, and a pair of voltage followers connected with said filter circuits, respectively, and a pair of inverters connected with said voltage followers, respectively.

8. A coin handling apparatus according to claim 7, wherein said coin stop control means includes a NOR gate connected with the inverters of said coin detecting unit for taking the logic sum of the output signals of said inverters and for inverting the logic sum taken, an AND gate for taking the logic product of the output of said NOR gate and the stop signal of said stop signal control means, and an SR flip-flop made receptive of the output of said AND gate for generating said controlled output signal.

* * * * *